US012441572B2

(12) United States Patent
Shiobara

(10) Patent No.: US 12,441,572 B2
(45) Date of Patent: Oct. 14, 2025

(54) ROTATION UNIT, POST-PROCESSING DEVICE, AND CONVEYING FORCE APPLYING MEMBER

(71) Applicant: SEIKO EPSON CORPORATION, Tokyo (JP)

(72) Inventor: Hiroshi Shiobara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 160 days.

(21) Appl. No.: 18/358,107

(22) Filed: Jul. 25, 2023

(65) Prior Publication Data

US 2024/0025690 A1 Jan. 25, 2024

(30) Foreign Application Priority Data

Jul. 25, 2022 (JP) ..... 2022-118221

(51) Int. Cl.

*B65H 31/36* (2006.01)
*B65H 31/02* (2006.01)
*B65H 31/26* (2006.01)

(52) U.S. Cl.

CPC ..... *B65H 31/36* (2013.01); *B65H 31/02* (2013.01); *B65H 31/26* (2013.01); *B65H 2404/1114* (2013.01); *B65H 2405/11151* (2013.01); *B65H 2408/121* (2013.01); *B65H 2601/324* (2013.01); *B65H 2801/06* (2013.01); *B65H 2801/27* (2013.01)

(58) Field of Classification Search

CPC ..... B65H 29/40; B65H 31/26; B65H 31/36; B65H 2404/1114; B65H 2601/324

See application file for complete search history.

(56) References Cited

U.S. PATENT DOCUMENTS 7,871,069 B2 * 1/2011 Lee ..... B65H 29/14 271/178

FOREIGN PATENT DOCUMENTS

JP 2007-039147 A 2/2007
JP 2018-184289 A 11/2018

* cited by examiner

*Primary Examiner* — Jeremy R Severson
(74) *Attorney, Agent, or Firm* — WORKMAN NYDEGGER

(57) ABSTRACT

A holding unit of a rotation unit includes a shaft hole through which a rotation shaft passes, and is fixed in a state of being attached to the rotation shaft by sliding in an axis direction of the rotation shaft. A conveying force applying unit includes a base portion provided with a fitting hole that fits an outer circumference of the holding unit and an opening portion in communication with the fitting hole, and a contact part provided to the base portion. The base portion is configured to deform, and the conveying force applying unit is configured to be attached to and detached from the holding unit via the opening portion in a direction crossing the axis direction of the rotation shaft.

15 Claims, 9 Drawing Sheets

ROTATION UNIT, POST-PROCESSING DEVICE, AND CONVEYING FORCE APPLYING MEMBER

The present application is based on, and claims priority from JP Application Serial Number 2022-118221, filed Jul. 25, 2022, the disclosure of which is hereby incorporated by reference herein in its entirety.

BACKGROUND

1. Technical Field

The present disclosure relates to a rotation unit that rotates and applies conveying force to a medium, and a post-processing device including the rotation unit. The present disclosure also relates to a conveying force applying member that applies the conveying force to the medium.

2. Related Art

JP-A-2018-184289 discloses an impeller including a shaft, a substantially cylindrical impeller boss attached to the shaft, and a tongue piece portion held by the impeller boss, the impeller being configured to tap a bill using the tongue piece portion.

The impeller boss is formed of a resin material so as to form an opening portion having a substantially C-shaped cross section. The opening portion can be widened to be larger than the diameter of the shaft.

The tongue piece portion is formed of an elastic material such as rubber, and includes a substantially C-shaped base portion and a plurality of tongue pieces radially extending from the base portion. The tongue piece portion is fixed to the impeller boss with the base portion and the root portion of each tongue piece fit in a groove portion of the impeller boss.

In the configuration described in JP-A-2018-184289 above, the impeller boss is an important configuration. This is because the tongue piece portion is soft and is difficult to be directly attached to the shaft. Further, the phase of the tongue piece portion with respect to the shaft is important. Preferably, a portion for attaching the tongue piece portion using the impeller boss has a large diameter, for the sake of suppression of phase shift of the tongue piece portion.

The configuration disclosed in JP-A-2018-184289 employs a structure in which, as described above, the tongue piece portion is fitted to the groove portion of the impeller boss, and the resultant integrated object is attached to the shaft, and the impeller boss needs to have a certain degree of flexibility because the opening portion having a substantially C-shaped cross section needs to be widened. The impeller boss thus having elasticity may lead to a phase shift of the impeller boss with respect to the shaft, resulting in a risk of a phase shift of the tongue piece portion with respect to the shaft.

SUMMARY

To solve the above-described problem, a rotation unit according to the present disclosure is a rotation unit configured to rotate to apply conveying force to a medium, the rotation unit including a conveying force applying unit including at least one contact part that is arranged in a rotation direction and comes into contact with the medium, and configured to apply the conveying force to the medium using the contact part, a rotation shaft to which the conveying force applying unit is attached, a holding unit provided between the rotation shaft and the conveying force applying unit, and configured to hold the conveying force applying unit, and a fixing unit configured to fix the conveying force applying unit to the rotation shaft, in which the holding unit includes a shaft hole through which the rotation shaft passes, and is fixed in a state of being attached to the rotation shaft by sliding in an axis direction of the rotation shaft, the conveying force applying unit includes a base portion provided with a fitting hole that fits an outer circumference of the holding unit and an opening portion in communication with the fitting hole, and the contact part provided to the base portion, the base portion is configured to deform, and the conveying force applying unit is configured to be attached to and detached from the holding unit via the opening portion in a direction crossing the axis direction of the rotation shaft.

A post-processing device according to the present disclosure is a post-processing device configured to execute post-processing on a medium on which recording is performed by a recording device, the post-processing device including a processing tray on which the medium to be subjected to the post-processing are loaded, an alignment unit configured to align an edge of the medium loaded on the processing tray, the above-described rotation unit configured to apply conveying force toward the alignment unit, to the medium, and a post-processing unit configured to execute the post-processing on the medium loaded on the processing tray.

A conveying force applying member according to the present disclosure is a conveying force applying member in a rotation unit including the conveying force applying member configured to apply conveying force to a medium, a rotation shaft to which the conveying force applying member is attached, a holding unit provided between the rotation shaft and the conveying force applying member, configured to hold the conveying force applying member, including a shaft hole through which the rotation shaft passes, and is fixed in a state of being attached to the rotation shaft by sliding in an axis direction of the rotation shaft, and a fixing unit configured to fix the conveying force applying member to the rotation shaft, the conveying force applying member including a base portion provided with a fitting hole that fits an outer circumference of the holding unit and an opening portion in communication with the fitting hole, and a contact part provided to the base portion, and configured to come into contact with the medium to apply the conveying force to the medium, in which the base portion is configured to deform, and the conveying force applying member is configured to be attached to and detached from the holding unit via the opening portion in a direction crossing the axis direction of the rotation shaft.

DESCRIPTION OF EXEMPLARY EMBODIMENTS

Figure 1:
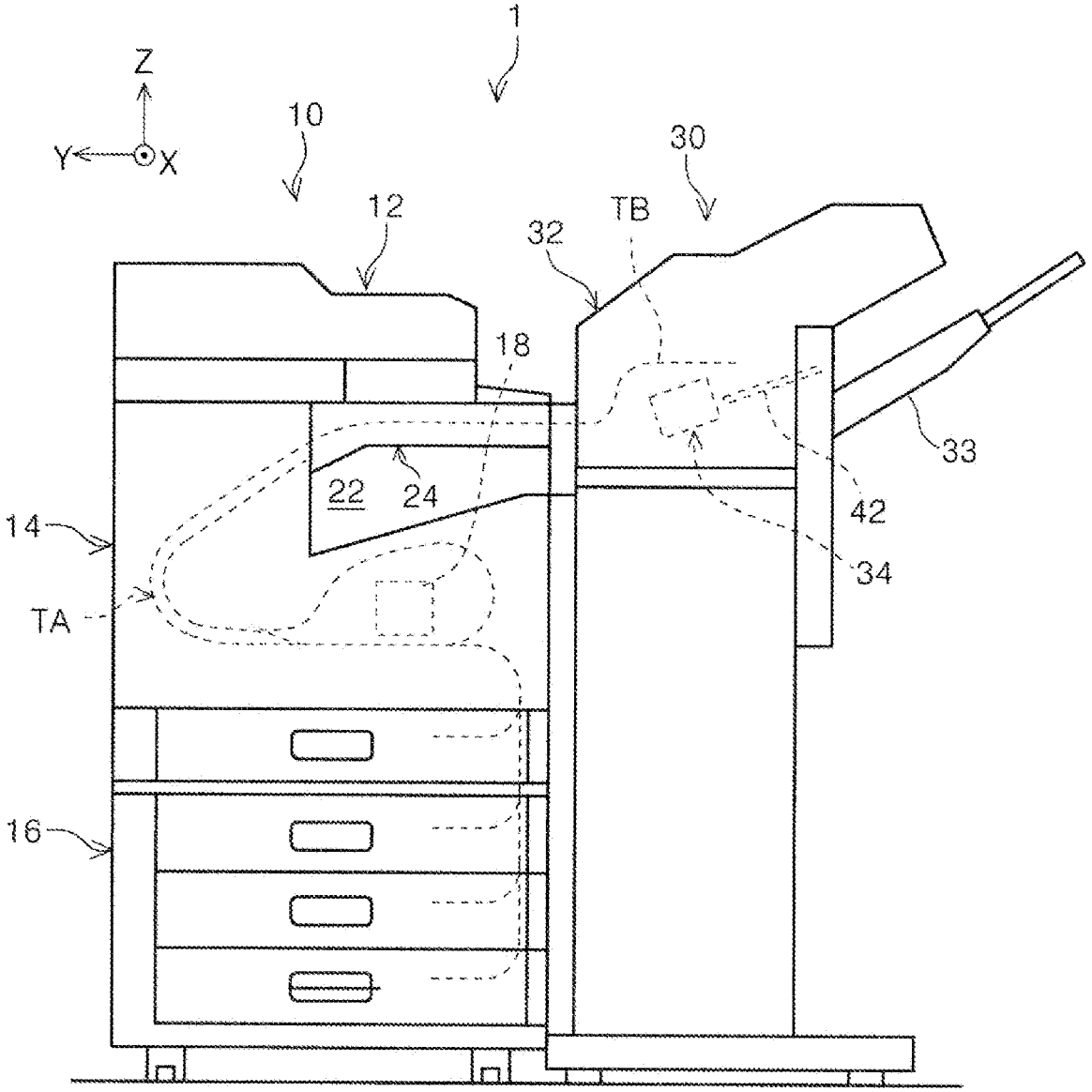
FIG. 1 is a front view of a recording system.

The present disclosure will be schematically described below.

A rotation unit according to a first aspect is a rotation unit configured to rotate to apply conveying force to a medium, the rotation unit including a conveying force applying unit including at least one contact part that is arranged in a rotation direction and comes into contact with the medium, and configured to apply the conveying force to the medium using the contact part, a rotation shaft to which the conveying force applying unit is attached, a holding unit provided between the rotation shaft and the conveying force applying unit, and configured to hold the conveying force applying unit, and a fixing unit configured to fix the conveying force applying unit to the rotation shaft, in which the holding unit includes a shaft hole through which the rotation shaft passes, and is fixed in a state of being attached to the rotation shaft by sliding in an axis direction of the rotation shaft, the conveying force applying unit includes a base portion provided with a fitting hole that fits an outer circumference of the holding unit and an opening portion in communication with the fitting hole, and the contact part provided to the base portion, the base portion is configured to deform, and the conveying force applying unit is configured to be attached to and detached from the holding unit via the opening portion in a direction crossing the axis direction of the rotation shaft.

According to the present aspect, since the holding unit includes the shaft hole through which the rotation shaft passes and is configured to be fixed in a state of being attached to the rotation shaft by sliding in the axis direction of the rotation shaft, the holding unit can be attached to the rotation shaft even when the holding unit is formed of a material having high hardness, and thus phase shift of the holding unit with respect to the rotation shaft can be suppressed.

Furthermore, since the conveying force applying unit held by the holding unit is configured to be attached and detached via the opening portion in the direction crossing the axis direction of the rotation shaft, the conveying force applying unit can be easily replaced from the holding unit. Thus, the holding unit can be used in common among apparatuses having different specifications, and versatility can be enhanced.

In the present specification, hardness refers to a degree of hardness, and having higher hardness means being harder and more difficult to deform. Hardness can be put into elastic modulus, and having higher elastic modulus means being harder and more difficult to deform.

According to a second aspect, in the first aspect, the rotation shaft has, on an outer circumference, a first arc portion and a first linear portion along a circumference direction, and the shaft hole of the holding unit is shaped to fit the outer circumference of the rotation shaft.

According to the present aspect, since the rotation shaft has, on the outer circumference, the first arc portion and the first linear portion along the circumference direction, and the shaft hole of the holding unit is shaped to fit the outer circumference of the rotation shaft, phase shift of the holding unit with respect to the rotation shaft can be reliably suppressed with a simple structure.

According to a third aspect, in the second aspect, the holding unit has, on the outer circumference, a second arc portion and a second linear portion along a circumference direction, and the fitting hole of the base portion is shaped to fit the outer circumference of the holding unit.

According to the present aspect, since the holding unit has, on the outer circumference, the second arc portion and the second linear portion along the circumference direction, and the fitting hole of the base portion is shaped to fit the outer circumference of the holding unit, phase shift of the conveying force applying unit with respect to the holding unit can be suppressed, that is, phase shift of the conveying force applying unit with respect to the rotation shaft can be further suppressed.

The present aspect is not limited to the above-described second aspect, and may be applied to the above-described first aspect.

According to a fourth aspect, in the third aspect, the holding unit has, on the second linear portion, a protruding portion protruding in a radial direction, and the base portion of the conveying force applying unit includes a portion that comes into contact with the protruding portion in the rotation direction.

According to the present aspect, since the holding unit has, on the second linear portion, the protruding portion protruding in the radial direction, and the base portion of the conveying force applying unit includes the portion that comes into contact with the protruding portion in the rotation direction, phase shift of the conveying force applying unit with respect to the holding unit can be further suppressed, that is, phase shift of the conveying force applying unit with respect to the rotation shaft can be further suppressed.

According to a fifth aspect, in the fourth aspect, the base portion of the conveying force applying unit is shaped to sandwich the protruding portion with a first portion and a second portion in the rotation direction.

According to the present aspect, since the base portion of the conveying force applying unit is shaped to sandwich the protruding portion with the first portion and the second portion in the rotation direction, phase shift of the conveying force applying unit with respect to the holding unit can be suppressed more reliably, that is, phase shift of the conveying force applying unit with respect to the rotation shaft can be suppressed more reliably.

According to a sixth aspect, in the fifth aspect, the protruding portion is provided at a position shifted from a center position of the second linear portion as viewed in the axis direction of the rotation shaft.

According to the present aspect, since the protruding portion is provided at a position shifted from the center position of the second linear portion as viewed in the axis direction of the rotation shaft, the direction in which the conveying force applying unit is attached with respect to the holding unit is fixed, whereby erroneous assembly can be prevented.

According to a seventh aspect, in the sixth aspect, the fixing unit includes a fixing member fixed to the rotation shaft, and the fixing member includes a fixed portion that is a portion fixed to the rotation shaft, and a restraining portion configured to restrain the protruding portion, the first portion, and the second portion.

According to the present aspect, the fixing unit includes the fixing member fixed to the rotation shaft, and the fixing member includes the fixed portion that is a portion fixed to the rotation shaft, and the restraining portion configured to restrain the protruding portion, the first portion, and the second portion. Thus, with the protruding portion, the first portion, and the second portion integrally restrained, phase shift of the conveying force applying unit with respect to the rotation shaft can be suppressed more reliably.

The present aspect is not limited to the above-described sixth aspect, and may be applied to the above-described fifth aspect.

According to an eighth aspect, in the seventh aspect, the fixed portion and the restraining portion are located at positions shifted from each other in the axis direction of the rotation shaft, and the fixing member includes a phase defining portion that is configured to define a phase of the fixing member with respect to the rotation shaft, and is a portion to be in contact with the first linear portion of the rotation shaft, the phase defining portion being located on a side opposite to the fixed portion in the axis direction with the restraining portion provided in between.

According to the present aspect, since the fixing member includes the phase defining portion that is configured to define the phase of the fixing member with respect to the rotation shaft, and is a portion to be in contact with the first linear portion of the rotation shaft, the phase defining portion being located on the side opposite to the fixed portion in the axis direction with the restraining portion provided in between, the phase of the fixing member with respect to the rotation shaft is defined, and thus phase shift of the conveying force applying unit with respect to the rotation shaft can be suppressed more reliably.

According to a ninth aspect, in the seventh aspect, a pressing portion configured to press the medium from above is included at a position different in phase from the contact part in the rotation direction, in which the pressing portion is fixed to the rotation shaft together with the fixed portion of the fixing member.

According to the present aspect, since the pressing portion configured to press the medium from above is included at a position different in phase from the contact part in the rotation direction, upward floating of the medium can be suppressed by the pressing portion. Furthermore, since the pressing portion is fixed to the rotation shaft together with the fixed portion of the fixing member, no dedicated means for fixing the pressing portion is required, whereby the number of components and cost can be reduced.

The present aspect is not limited to the above-described seventh aspect, and may be applied to the above-described eighth aspect.

According to a tenth aspect, in the first aspect, the conveying force applying unit includes a plurality of the contact parts arranged in the rotation direction.

According to the present aspect, since the conveying force applying unit includes the plurality of contact parts arranged in the rotation direction, the medium can be conveyed more reliably than with a configuration including one contact part in the rotation direction.

The present aspect is not limited to the above-described first aspect, and may be applied to any one of the above-described second to ninth aspects.

According to an eleventh aspect, in the first aspect, a plurality of rotation bodies are provided along the axis direction of the rotation shaft, the rotation bodies each being a set of the conveying force applying unit, the holding unit, and the fixing unit.

According to the present aspect, since the plurality of rotation bodies are provided along the axis direction of the rotation shaft, the rotation bodies each being a set of the conveying force applying unit, the holding unit, and the fixing unit, the medium can be conveyed more reliably than with a configuration including one rotation body in the axis direction.

When the plurality of rotation bodies are provided in the axis direction, in a configuration in which the conveying force applying unit is configured to be attached and detached in the axis direction, another rotation body becomes an obstacle. However, since the conveying force applying unit is configured to be attached and detached in a direction crossing the axis direction, another rotation body does not become an obstacle, and the conveying force applying unit can be easily attached and detached.

The present aspect is not limited to the above-described first aspect, and may be applied to any one of the above-described second to tenth aspects.

According to a twelfth aspect, in the eleventh aspect, the axis direction of the rotation shaft is a width direction of the medium, the plurality of rotation bodies provided along the width direction include two first rotation bodies that are provided to sandwich a center position in the width direction, while being equidistant from the center position, and two second rotation bodies that are located closer to an edge of the medium in the width direction than the first rotation bodies are, and are provided to sandwich the center position, while being equidistant from the center position, and conveying force applied to the medium from the second rotation bodies is larger than conveying force applied to the medium from the first rotation bodies.

The plurality of rotation bodies provided in the width direction designed to apply the same conveying force to the medium, may lead to variation in conveying force among the plurality of rotation bodies due to an assembly error, aging, or the like, which may result in skew of the medium. According to the present aspect, since the conveying force applied to the medium by the second rotation body positioned on the outer side in the width direction is larger than the conveying force applied to the medium by the first rotation body positioned on the inner side with respect to the second rotation body from the beginning, it is possible to suppress the occurrence of the above-described skew.

A post-processing device according to a thirteenth aspect is a post-processing device configured to execute post-processing on a medium on which recording has been performed by a recording device, the post-processing device including a processing tray on which the medium to be subjected to the post-processing are loaded, an alignment unit configured to align edges of the medium loaded on the processing tray, the rotation unit according to any one of the first to twelfth aspects configured to apply conveying force toward the alignment unit, to the medium, and a post-processing unit configured to execute the post-processing on the medium loaded on the processing tray.

According to the present aspect, in the post-processing device configured to execute post-processing on a medium on which recording has been performed by the recording device, operational effects of any one of the above-described first to twelfth aspects can be obtained.

According to a fourteenth aspect, in the thirteenth aspect, a guide positioned above the processing tray and configured to guide, toward the alignment unit, the medium sent toward the alignment unit by the rotation unit is included, in which the guide is located at a position shifted from the conveying force applying unit in the axis direction of the rotation shaft.

According to the present aspect, since the guide that is positioned above the processing tray and guides the medium sent toward the alignment unit by the rotation unit toward the alignment unit is provided, it is possible to appropriately bring the edge of the medium into contact with the alignment unit. Since the guide is located at a position shifted from the conveying force applying unit in the axis direction of the rotation shaft, the possibility of the guide becoming an obstacle can be suppressed when the conveying force applying unit is attached or detached.

A fifteen aspect provides a conveying force applying member in a rotation unit including the conveying force applying member configured to apply conveying force to a medium, a rotation shaft to which the conveying force applying member is attached, a holding unit provided between the rotation shaft and the conveying force applying member, configured to hold the conveying force applying member, including a shaft hole through which the rotation shaft passes, and is fixed in a state of being attached to the rotation shaft by sliding in an axis direction of the rotation shaft, and a fixing unit configured to fix the conveying force applying member to the rotation shaft, the conveying force applying member including a base portion provided with a fitting hole that fits an outer circumference of the holding unit and an opening portion in communication with the fitting hole, and a contact part provided to the base portion, and configured to come into contact with the medium to apply the conveying force to the medium, in which the base portion is configured to deform, and the conveying force applying member is configured to be attached to and detached from the holding unit via the opening portion in a direction crossing the axis direction of the rotation shaft.

According to the present aspect, since the holding unit includes the shaft hole through which the rotation shaft passes and is configured to be fixed in a state of being attached to the rotation shaft by sliding in the axis direction of the rotation shaft, the holding unit can be attached to the rotation shaft even when the holding unit is formed of a material having high hardness, and thus phase shift of the holding unit with respect to the rotation shaft can be suppressed.

Since the conveying force applying unit held by the holding unit is configured to be attached and detached via the opening portion in the direction crossing the axis direction of the rotation shaft, the conveying force applying unit can be easily replaced from the holding unit. Thus, the holding unit can be used in common among apparatuses having different specifications, and versatility can be enhanced.

The present disclosure will be specifically described below.

A post-processing device 30 according to an embodiment of the present disclosure will be described below.

In each drawing, the X-axis direction is a device depth direction of the post-processing device 30 and a recording system 1. The X-axis direction includes a +X direction that is indicated by the arrow and is a direction from a device back surface toward a device front surface, and a −X direction that is a direction from the device front surface toward the device back surface. The X-axis direction is an example of a medium width direction.

A Y-axis direction is a device width direction of the post-processing device 30 and the recording system 1. The Y-axis direction includes a +Y direction that indicated by the arrow and is a left direction as viewed from a user facing the device front surface, and a −Y direction is a right direction.

A Z-axis direction is a device height direction of the post-processing device 30 and the recording system 1, that is, a vertical direction, and includes a +Z direction that is indicated by the arrow and is vertically upward, and a −Z direction that is vertically downward. In the following description, the +Z direction may be simply referred to as upward and the −Z direction may be simply referred to as downward.

As illustrated in FIG. 1, the recording system 1 includes a recording device 10 and a post-processing device 30. The recording device 10 according to the present embodiment is an inkjet printer that performs recording by ejecting ink, which is an example of liquid, onto a medium represented by a recording sheet, and includes a line head 18, which is an example of a recording unit. The recording device 10 is what is known as a multifunction peripheral including a scanner unit 12 in an upper portion of the device.

The recording device 10 includes a main body unit 14, a medium accommodation unit 16 that accommodates the medium, a medium conveying unit (not illustrated) that conveys the medium, the line head 18 that performs recording on the medium, an in-body discharge unit 22 to which the medium is discharged, and a relay unit 24 conveys the medium to the post-processing device 30. A conveyance path TA on which the medium is conveyed is provided in the main body unit 14.

The line head 18 has a plurality of ink ejection nozzles (not illustrated) arranged corresponding to the entire region of the medium in the X-axis direction. The line head 18 performs recording on the medium by ejecting ink, supplied from an ink tank (not illustrated), onto the medium from the plurality of ink ejection nozzles.

The medium on which recording has been performed by the recording device 10 is sent to the post-processing device 30 via the relay unit 24. The post-processing device 30 includes a device main body 32, a processing tray 42 provided inside the device main body 32, a stapler 34 which is an example of a post-processing unit, and a main tray 33 provided outside the device main body 32.

The medium delivered from the relay unit 24 to the device main body 32 is conveyed along a conveyance path TB inside the device main body 32 is and sent to the processing tray 42.

A configuration of the post-processing device 30 will be further described below with reference to FIG. 2.

Hereinafter, the medium is denoted by a reference sign P, and thus is referred to as a medium P. A media bundle including a plurality of the media P is denoted by a reference sign Pt and thus is referred to as a media bundle Pt.

Figure 2:
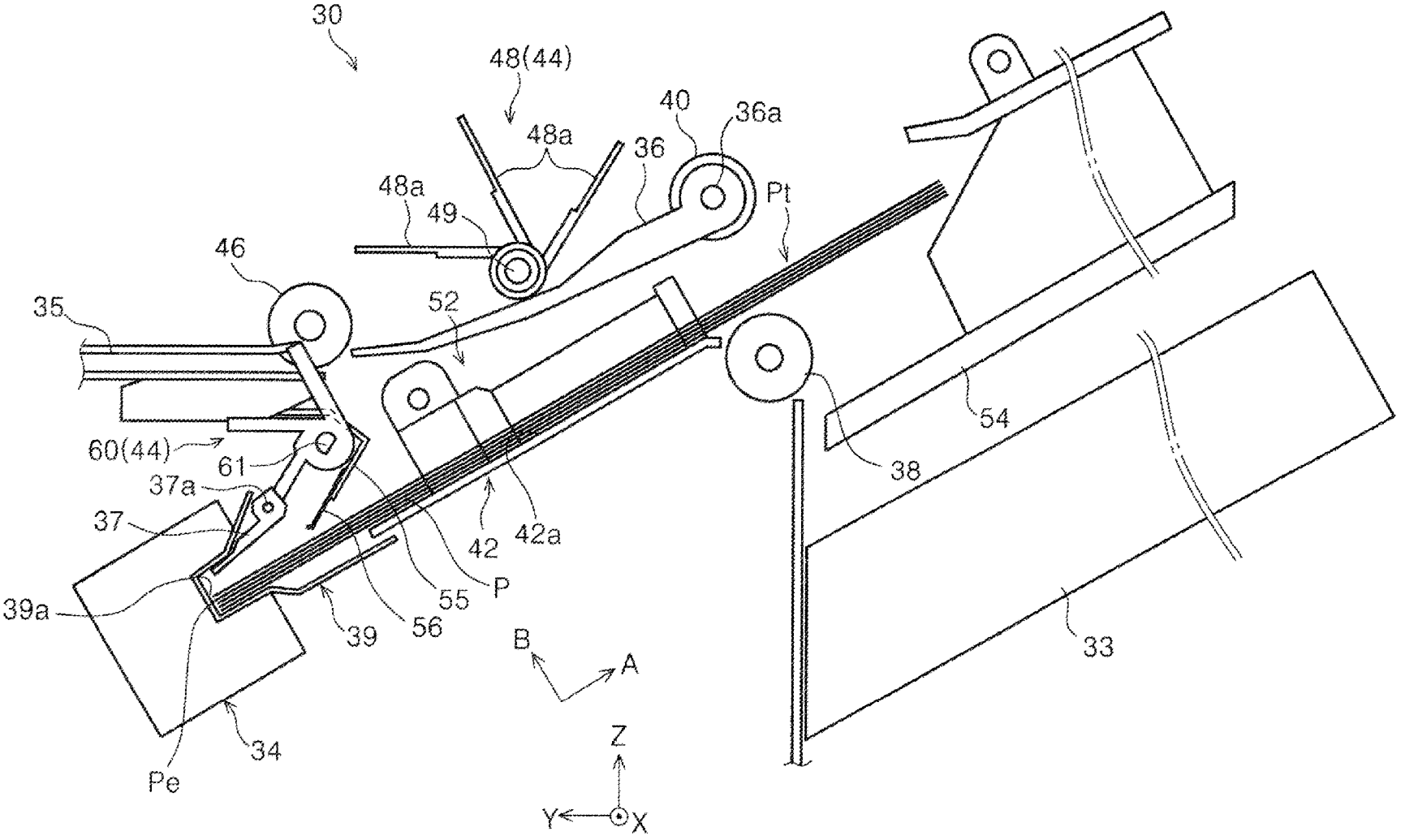
FIG. 2 is a diagram illustrating an internal configuration of a post-processing device.

In FIG. 2, an A-axis direction is a direction along a support surface 42*a* of the processing tray 42, includes a +A direction that is a direction in which the media P is fed into the processing tray 42, and A-A direction is a direction in which the medium P on the processing tray 42 is pulled back toward a trailing edge alignment unit 39. The A-axis direction is a direction including a +Z direction component and a −Y direction component in the present embodiment. A direction orthogonal to the A-axis direction as viewed in the X-axis direction is set as a B-axis direction.

A guide member 35 that is part of the conveyance path TB extends toward the processing tray 42. The medium P conveyed in the −Y direction along the guide member 35 is sent toward the processing tray 42 by a conveyance roller 46 driven by a motor (not illustrated).

The medium P sent to the processing tray 42 receives conveying force toward the trailing edge alignment unit 39 by a pullback unit 44, to be pulled back in the −A direction. The pullback unit 44 includes a first pullback unit 48 and a second pullback unit 60. The term "pullback unit" may be rephrased as "paddle unit". The second pullback unit 60 is an example of a rotation unit.

The first pullback unit 48 includes a plurality of (three in the present embodiment) contact parts 48*a* made of an elastic material such as rubber along the rotation direction. The contact parts 48*a* are provided to be rotatable about a rotation shaft 49 extending along the X-axis direction. The first pullback unit 48 is driven by a motor (not illustrated) in the clockwise direction in FIG. 2, and thereby applies feeding force, in the −A direction, to the medium P fed to the processing tray 42.

The configuration of the second pullback unit 60 will be described in detail below.

The trailing edge alignment unit 39 is provided in the −A direction with respect to the processing tray 42. The trailing edge alignment unit 39 has an alignment surface 39*a* parallel to the B-axis direction, and a trailing edge Pe of the media bundle Pt on the processing tray 42 abuts against the alignment surface 39*a*, whereby the trailing edge Pe of the media bundle Pt is aligned.

The processing tray 42 has an upper portion provided with a first guide 55 and a second guide 56. The first guide 55 and the second guide 56 guide the trailing edge Pe of the medium P pulled back in the −A direction by the pullback unit 44 toward the trailing edge alignment unit 39. With this configuration, the trailing edge Pe of the medium P can be appropriately brought into contact with the trailing edge alignment unit 39. The first guide 55 is formed of a metal plate material for example, and the second guide 56 is formed of a flexible sheet material for example.

Side cursors 52 are provided to be movable in the X-axis direction by a driving source (not illustrated), and align the edges of the media bundle Pt in the X-axis direction supported by the processing tray 42 by coming into contact with the edge portions. The side cursors 52 are spaced apart from each other along the X-axis direction, and the two side cursors 52 are provided so as to move toward and away from each other. FIG. 2 illustrates one of the two side cursors 52 that is provided in the −X direction.

A flap 37 is arranged side by side with the trailing edge alignment unit 39 along the X-axis direction and is provided to be swingable about a shaft portion 37*a* extending in the X-axis direction. The flap 37 presses the media bundle Pt on the processing tray 42 downward in the vicinity of the trailing edge alignment unit 39.

A pressing member 36 is provided to be swingable about a shaft portion 36*a* extending in the X-axis direction. The pressing member 36 is provided to be rotatable by a motor (not illustrated), and rotates to slap the medium P fed toward the processing tray 42 by the conveyance roller 46, down toward the processing tray 42. Thus, the −A direction edge of the medium P sent toward the processing tray 42 is appropriately guided to the trailing edge alignment unit 39.

A discharge roller 38 driven by a motor (not illustrated) is provided in the +A direction with respect to the processing tray 42. A discharge driven roller 40 is provided above the discharge roller 38 to be movable toward and away from the discharge roller 38. The discharge driven roller 40 is separated from the discharge roller 38 until the media bundle Pt is discharged from the processing tray 42. When the media bundle Pt is discharged from the processing tray 42, the discharge driven roller 40 is moved by a power source (not illustrated) toward the discharge roller 38, whereby the media bundle Pt is nipped between the discharge driven roller 40 and the discharge roller 38.

The discharge roller 38 feeds the media bundle Pt supported by the processing tray 42 and having been subjected to binding processing by the stapler 34, toward a lower support tray 54. Post-processing according to the present embodiment is the binding processing executed by the stapler 34, but is not limited to this, and may be punching processing of punching a punch hole in the media bundle Pt, saddle stitch processing of saddle stitching the media bundle Pt, shift discharge processing with which the media bundle Pt is discharged with the discharge position alternately shifted in the medium width direction, or the like. The media bundles Pt may be discharged onto the main tray 33 without the post-processing, to be loaded in what is known as a piled manner.

Although not illustrated, the lower support tray 54 includes two trays that are provided at an interval in the X-axis direction, that is, the medium width direction, and provided to be movable toward and away from each other using driving force from a driving source (not illustrated). The lower support trays 54 are opened by moving in a direction away from each other and closed by moving in a direction toward each other. FIG. 2 illustrates one of the two lower support trays 54 that are provided at an interval in the medium width direction that is provided in the −X direction.

The media bundle Pt discharged by the discharge roller 38 is temporarily supported by the closed lower support trays 54. When the lower support trays 54 open, the media bundle Pt supported by the lower support trays 54 falls onto the main tray 33. By providing such lower support trays 54, the alignment performance of the media bundle Pt on the main tray 33 can be improved. Needless to say, the media bundle Pt may be directly discharged from the processing tray 42 toward the main tray 33 without providing the lower support tray 54.

The main tray 33 is provided so as to be displaceable in the Z-axis direction, that is, the loading direction by a motor (not illustrated).

Next, a configuration of the second pullback unit 60 which is an example of the rotation unit will be described in detail.

Figure 3:
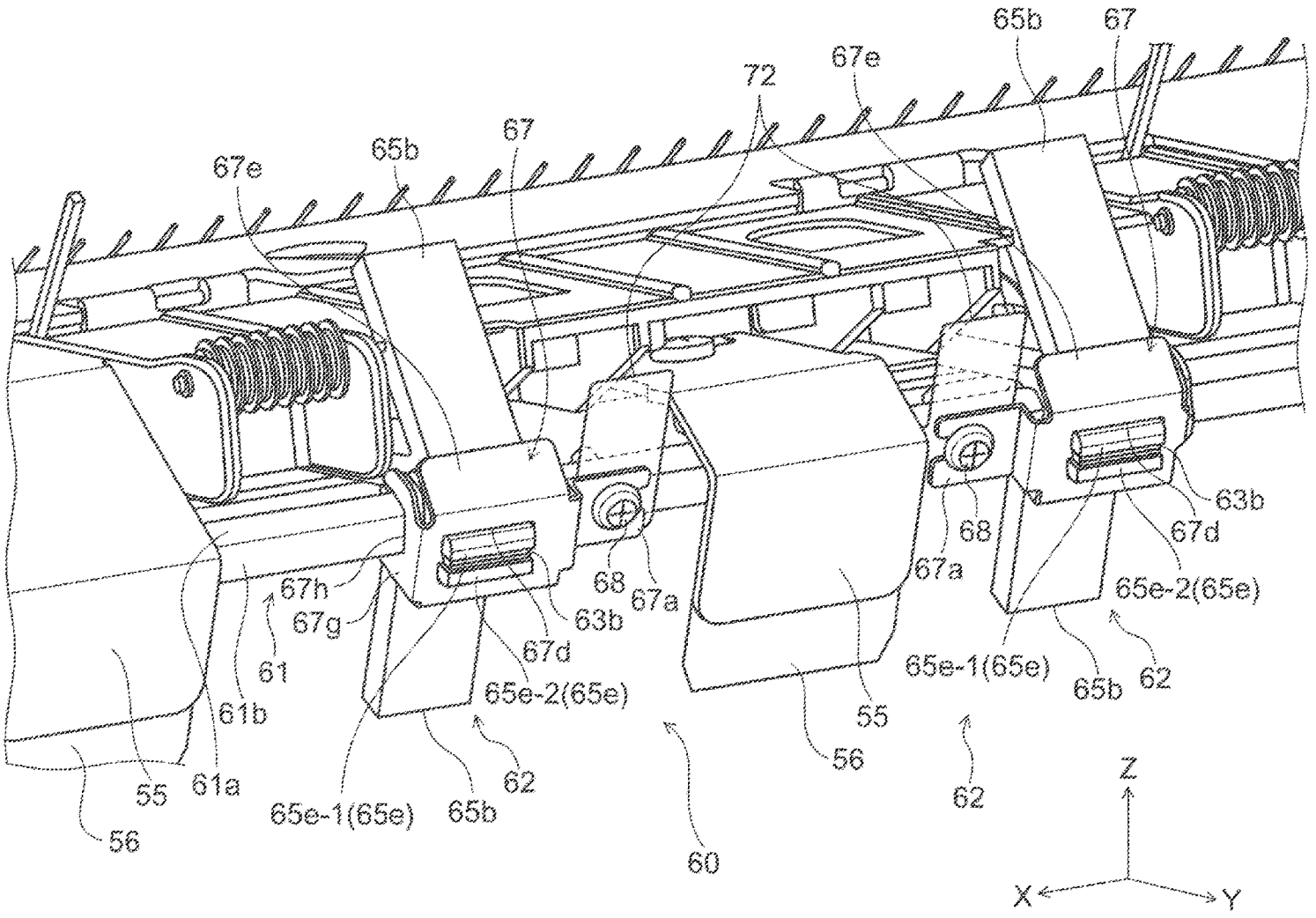
FIG. 3 is a perspective view of a rotation unit.

As illustrated in FIG. 3, the second pullback unit 60 includes a rotation shaft 61 whose axis direction is the X-axis direction, and a plurality of rotation bodies 62 provided at an interval along the axis direction of the rotation shaft 61, that is, the medium width direction. In the present embodiment, one rotation body 62 is disposed on each of the left and right sides with respect to the center position of the medium P in the medium width direction, and the rotation bodies 62 are disposed at positions symmetrical about the center position of the medium P.

In the second pullback unit 60, the rotation shaft 61, that is, the rotation bodies 62 are driven in the clockwise direction in FIG. 2 by a motor (not illustrated). Thus, the rotation bodies 62 apply the feeding force in the −A direction to the medium P fed to the processing tray 42.

Figure 4:
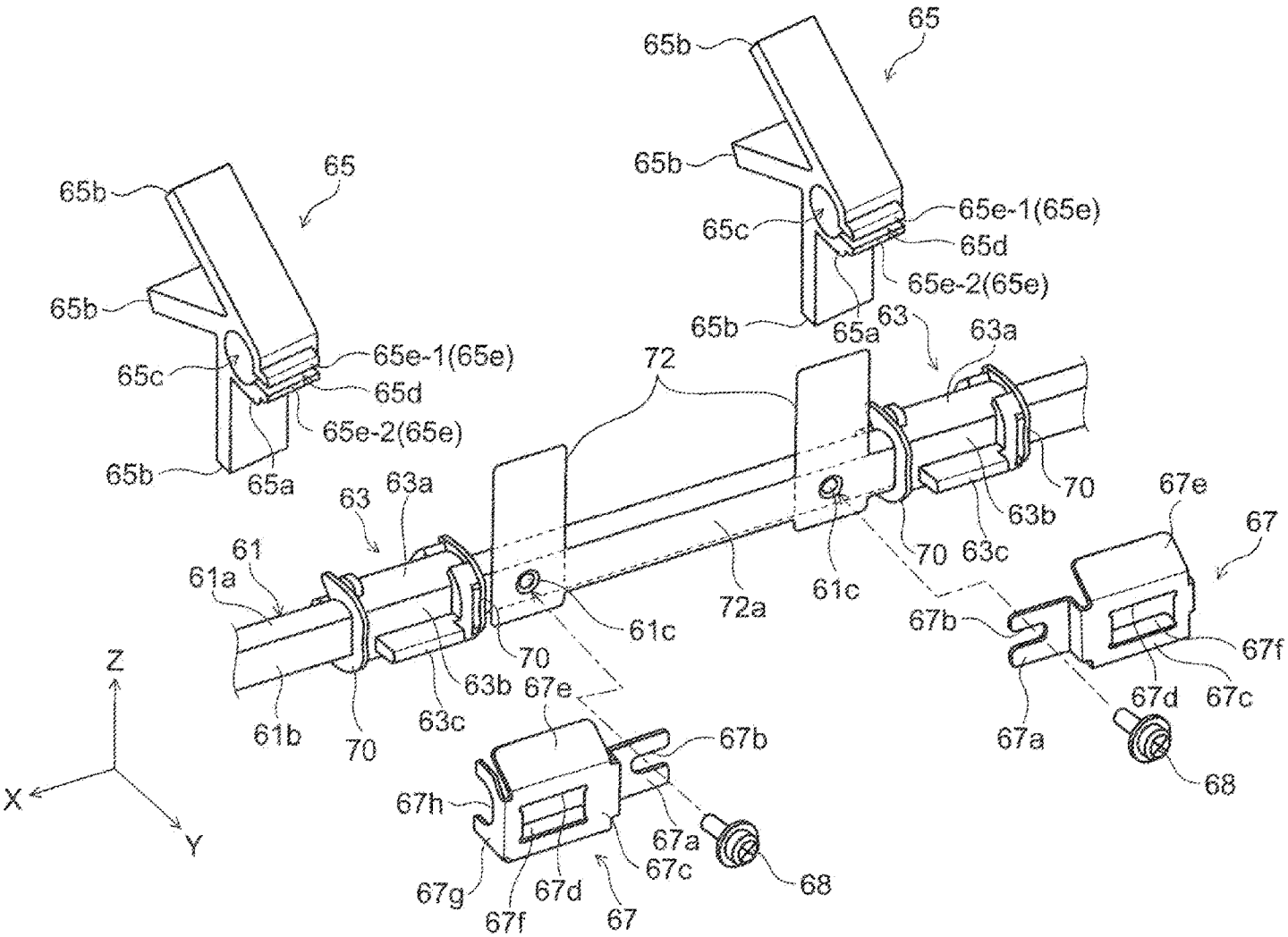
FIG. 4 is a partially exploded perspective view of the rotation unit.

As illustrated in FIG. 3 and FIG. 4, the rotation bodies 62 are each a set of a holding member 63 that is an example of a holding unit, a conveying force applying member 65 that is an example of a conveying force applying unit, and a fixing member 67 that is an example of a fixing unit.

Figure 7A:
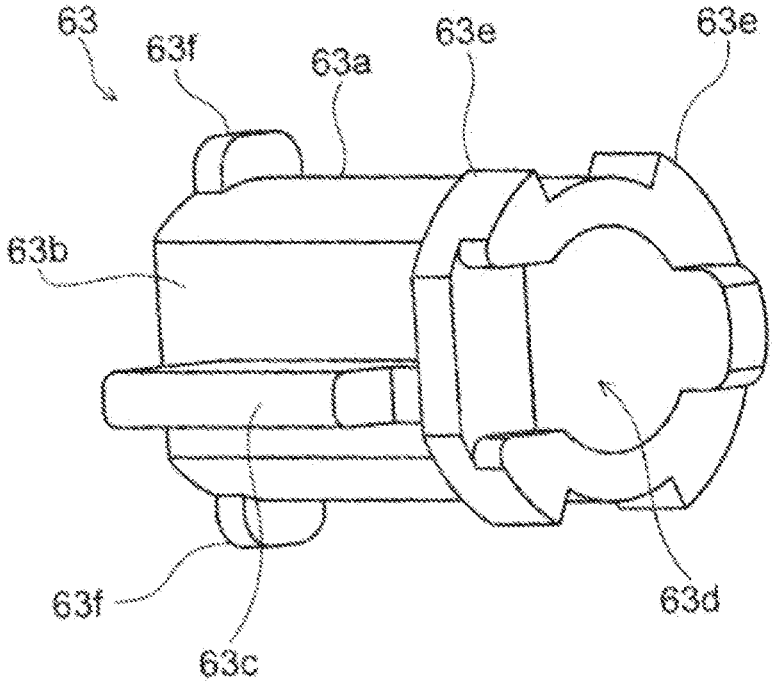
FIG. 7A and FIG. 7B are perspective views of the holding member.
Figure 7B:
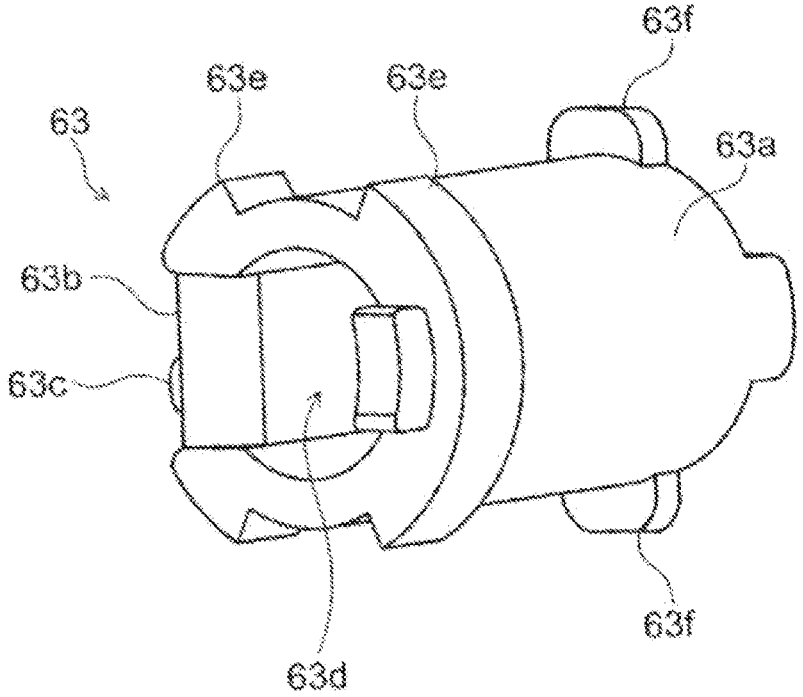
Figure 8:
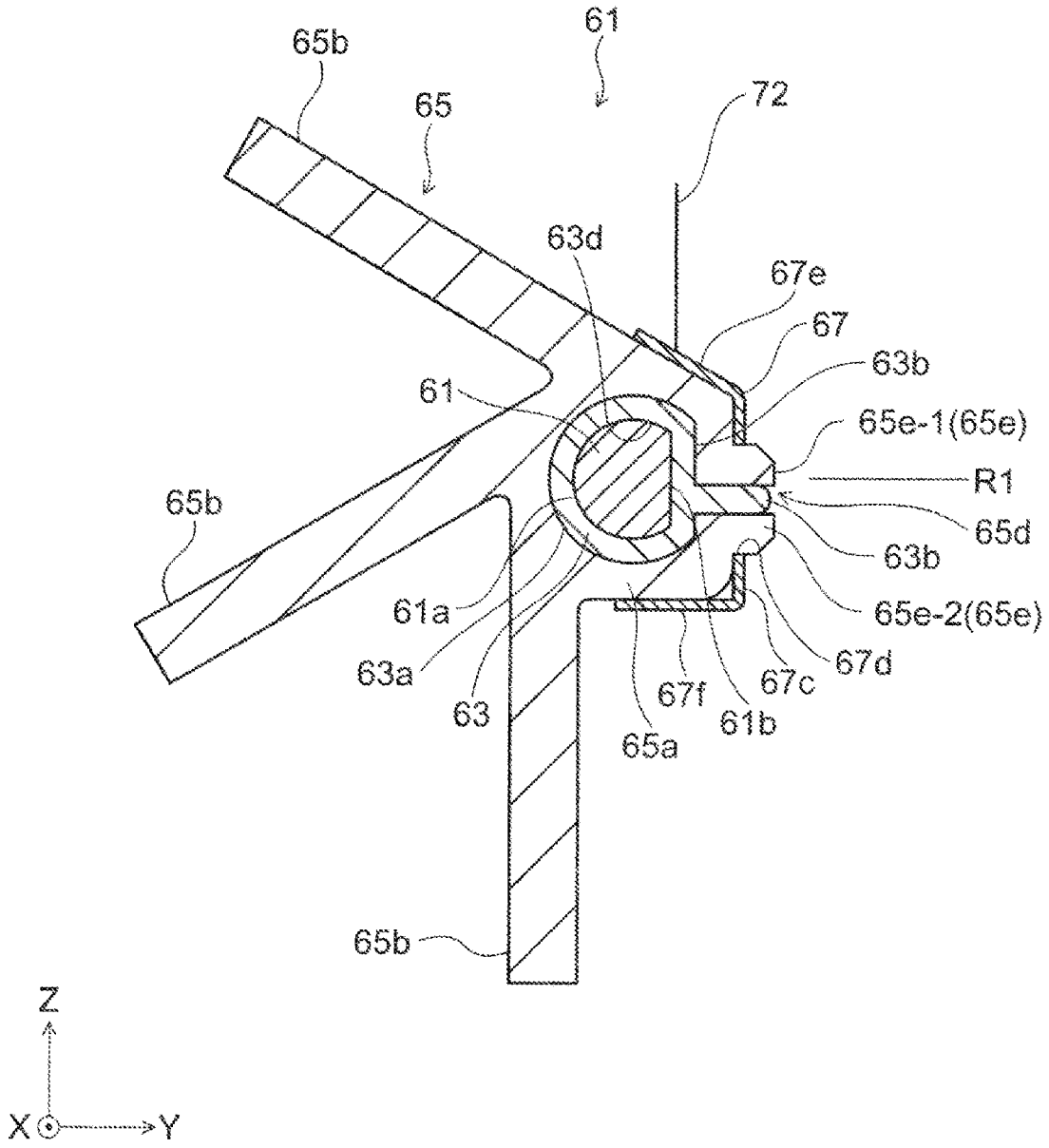
FIG. 8 is a cross-sectional view of the rotation unit taken along the axis direction.

The outer circumference of the rotation shaft 61 to which the rotation bodies 62 are attached has a first arc portion 61*a* and a first linear portion 61*b* along the circumference direction, and forms a D-cut shape as viewed in the axis direction (see FIG. 8). On the outer circumference of the rotation shaft 61, the first arc portion 61*a* is formed by a curved surface without irregularities, and the first linear portion 61*b* is formed by a flat surface without irregularities. As illustrated in FIG. 7A and FIG. 7B, the holding member 63 has a shaft hole 63*d* through which the rotation shaft 61 passes, and the shaft hole 63*d* is shaped to fit the outer circumference of the rotation shaft 61, that is, has a D-cut shape similar to that of the rotation shaft 61 as viewed in the axis direction (see FIG. 8). Thus, phase shift of the holding member 63 with respect to the rotation shaft 61 can be reliably suppressed with a simple structure.

Any unit can be used for fixing the holding member 63 to the rotation shaft 61 in the rotation direction may be used. For example, the holding member 63 may be fixed to the rotation shaft 61 by a screw, an adhesive, or a pin-shaped member passing through the holding member 63 and the rotation shaft 61. In this case, the rotation shaft 61 may not include the first linear portion 61*b* and may have a perfect circular shape as viewed in the axis direction.

The rotation shaft 61 which can be formed of a metal material, a resin material, or the like, preferably has as high a hardness as possible for the sake of torsion suppression.

Figure 5:
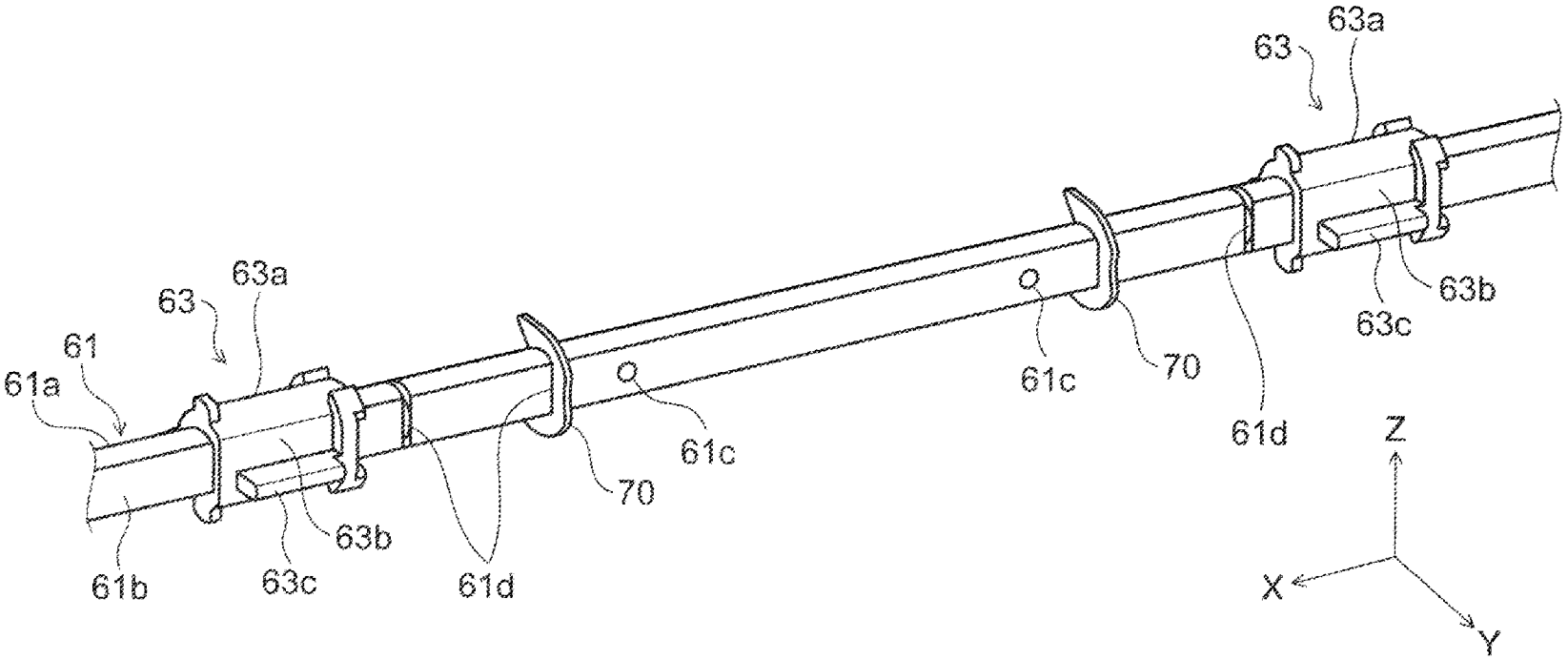
FIG. 5 is a diagram illustrating an intermediate state of a process of mounting a holding member to a rotation shaft through sliding in an axis direction.

The holding member 63 is attached to the rotation shaft 61 by sliding in the axis direction. The holding member 63 is fixed in a state of being attached to the rotation shaft 61 by sliding in the axis direction. In the present embodiment, a groove 61*d* into which a retaining ring 70 is fitted is formed in the rotation shaft 61 as illustrated in FIG. 5, and the holding member 63 is fixed in the axis direction by being sandwiched between the retaining rings 70 on both sides in the axis direction after sliding in the axis direction with respect to the rotation shaft 61.

Any unit can be used for fixing the holding member 63 to the rotation shaft 61 in the axis direction may be used. For example, the holding member 63 may be fixed to the rotation shaft 61 by a screw, an adhesive, or a pin-shaped member passing through the holding member 63 and the rotation shaft 61.

Figure 6:
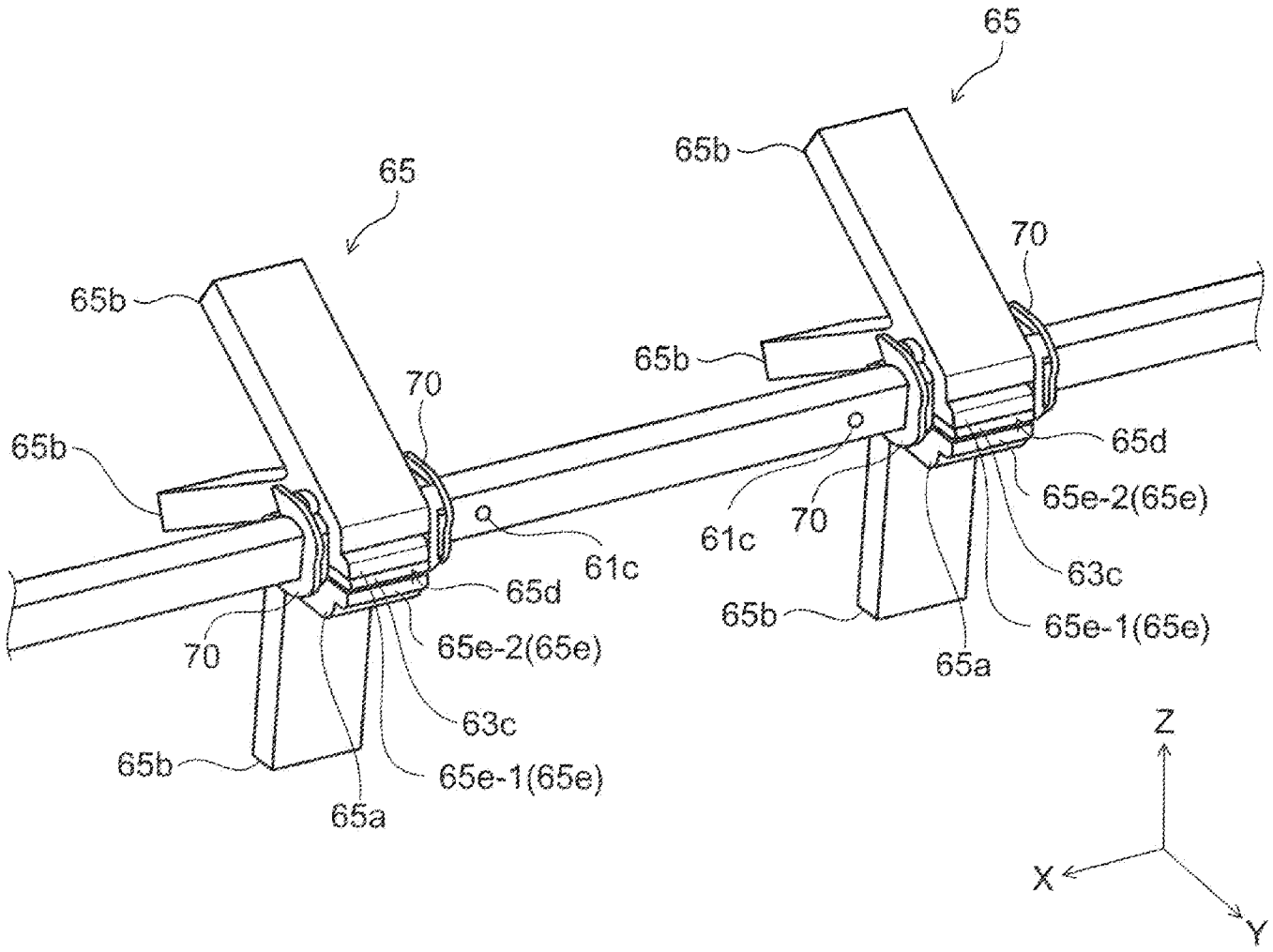
FIG. 6 is a perspective view of a state in which a conveying force applying member is attached to the holding member.

As illustrated in FIG. 7A and FIG. 7B, the outer circumference of the holding member 63 has a second arc portion 63*a* and a second linear portion 63*b* along the circumference direction, and forms a D-cut shape as viewed in the axis direction (see FIG. 8). On the outer circumference of the holding member 63, the second arc portion 63*a* us formed by a curved surface without irregularities, and the second linear portion 63*b* is formed by a flat surface having irregularities in only a portion where a protruding portion 63*c* described below is formed. As illustrated in FIG. 6, the holding member 63 holds the conveying force applying member 65 on the outer circumference as described above. Specifically, the holding member 63 is interposed between the rotation shaft 61 and the conveying force applying member 65 to hold the conveying force applying member 65.

The holding member 63 can be formed of a metal material, a resin material, or the like. The holding member 63 is formed of a material having higher hardness than at least the conveying force applying member 65 described below.

The holding member 63 may be formed of the same material as the rotation shaft 61. When the holding member 63 is made of a material different from that of the rotation shaft 61, the hardness of the holding member 63 may be the same as that of the rotation shaft 61, lower than that of the rotation shaft 61, or higher than that of the rotation shaft 61.

As illustrated in FIGS. 4 and 8, the conveying force applying member 65 integrally includes a base portion 65*a* and a plurality of contact parts 65*b* protruding from the base portion 65*a* in a direction including the radial direction. In the present embodiment, three contact parts 65*b* are formed at an equal interval along the rotation direction. However, the positions and the number of the contact parts 65*b* formed are not limited thereto. The contact part 65*b* comes into contact with the medium through elastic deformation and applies conveying force to the medium.

The base portion 65*a* has a fitting hole 65*c* that fits the outer circumference of the holding member 63, and has an opening portion 65*d* in communication with the fitting hole 65*c*. The base portion 65*a* is configured to deform so that the size of the opening portion 65*d* can be increased and then reduced. Thus, the conveying force applying member 65 is configured to be attached to and detached from the holding member 63 in a direction (for example, the Y-axis direction) crossing the axis direction.

The conveying force applying member 65 can be formed of an elastically deformable material such as rubber or elastomer. Alternatively, for example, the base portion 65*a* and the contact part 65*b* may be compositely molded with different materials. In this case, the base portion 65*a* may be formed of a resin material, and the contact part 65*b* may be formed of rubber, elastomer, or the like so as to have a hardness lower than that of the base portion 65*a*.

The fitting hole 65*c* of the conveying force applying member 65 is shaped to fit the outer circumference of the holding member 63, that is, has a D-cut shape that is similar to that of the outer circumference of the holding member 63 as viewed in the axis direction.

Accordingly, it is possible to suppress a phase shift of the conveying force applying member 65 with respect to the holding member 63, that is, it is possible to suppress a phase shift of the conveying force applying member 65 with respect to the rotation shaft 61.

In the second linear portion 63*b* on the outer circumference of the holding member 63, the protruding portion 63*c* is formed to protrude in the radial direction. On the other hand, a contact portion 65*e* is formed at the conveying force applying member 65 to come into contact with the protruding portion 63*c* in the rotation direction. The contact portion 65*e* includes a first portion 65*e*-1 and a second portion 65*e*-2, with the first portion 65*e*-1 and the second portion 65*e*-2 sandwiching the protruding portion 63*c* in the rotation direction.

Since the protruding portion 63*c* is formed at the holding member 63 and the contact portion 65*e* is formed at the conveying force applying member 65 as described above, the phase shift of the conveying force applying member 65 with respect to the holding member 63 can be further suppressed, that is, the phase shift of the conveying force applying member 65 with respect to the rotation shaft 61 can be further suppressed.

Since the protruding portion 63*c* is sandwiched between the first portion 65*e*-1 and the second portion 65*e*-2 in the rotation direction, it is possible to more reliably suppress the phase shift of the conveying force applying member 65 with respect to the holding member 63, that is, to more reliably suppress the phase shift of the conveying force applying member 65 with respect to the rotation shaft 61.

Here, as illustrated in FIG. 8, the protruding portion 63*c* is provided at a position shifted from a center position R1 of the second linear portion 63*b* as viewed in the axis direction of the rotation shaft 61. Thus, the direction in which the conveying force applying member 65 is attached with respect to the holding member 63 is fixed, whereby erroneous assembly can be prevented.

As illustrated in FIG. 7A and FIG. 7B, an enlarged diameter portion 63*e* is formed at one end of the outer circumference of the holding member 63 in the axis direction, and a projection 63*f* is formed at the other end. The enlarged diameter portion 63*e* and the projection 63*f* restrict movement of the conveying force applying member 65 attached to the holding member 63 in the axis direction.

Next, a configuration of the fixing member 67 will be described. The fixing member 67 which fixes the conveying force applying member 65 to the rotation shaft 61 includes a fixed portion 67*a* which is a portion fixed to the rotation shaft 61 as illustrated in FIG. 4, and a restraining portion 67*c* which restrains the protruding portion 63*c* of the holding member 63 described above and the first portion 65*e*-1 and the second portion 65*e*-2 of the conveying force applying member 65.

A groove 67*b* opened in the axis direction is formed in the fixed portion 67*a*, and the fixed portion 67*a* is fixed to the rotation shaft 61 using a screw 68 via the groove 67*b*. In FIG. 4, reference sign 61*c* denotes a screw hole formed in the first linear portion 61*b* of the rotation shaft 61.

An opening 67*d* is formed in the restraining portion 67*c*, and as illustrated in FIG. 3, the protruding portion 63*c* of the holding member 63 and the first portion 65*e*-1 and the second portion 65*e*-2 of the conveying force applying member 65 enter the opening 67*d* to integrally restrained in the rotation direction and the axis direction. Thus, phase shift of the conveying force applying member 65 with respect to the rotation shaft 61 can be more reliably suppressed with a simple structure.

The restraining portion 67*c* is not limited to such a configuration, and may be any configuration as long as the conveying force applying member 65 can be fixed to the rotation shaft 61 in the rotation direction. Still, as in the present embodiment, it is more preferable to employ a configuration in which an increase in the size of the opening portion 65*d* of the conveying force applying member 65 can be restricted. A unit for restricting the increase in the size of the opening portion 65*d* of the conveying force applying member 65 and a unit for fixing the conveying force applying member 65 to the rotation shaft 61 in the rotation direction may be separately provided.

In the present embodiment, the fixing member 67 serves as the fixing unit for fixing the conveying force applying member 65 to the rotation shaft 61, but the present disclosure is not limited thereto. For example, the conveying force applying member 65 may be fixed to the holding member 63 and thus the conveying force applying member 65 may be fixed to the rotation shaft 61 using a fixing unit such as a double-sided tape.

In addition, in the present embodiment, the fixing member 67 is fixed to the rotation shaft 61 by a screw, but the present disclosure is not limited thereto, and the fixing member 67 may be fixed to the rotation shaft 61 by means of snap fit or the like.

In addition, in the fixing member 67 according to the present embodiment, the fixed portion 67*a* and the restraining portion 67*c* are located at positions shifted from each other in the axis direction, and the fixing member 67 includes, on the opposite side of the fixed portion 67*a* with respect to the restraining portion 67*c* in the axis direction, a phase defining portion 67*g* that comes into contact with the first linear portion 61*b* of the rotation shaft 61 and defines the phase of the fixing member 67 with respect to the rotation shaft 61. A linear contact surface 67*h* is formed in the phase defining portion 67*g*, and the phase of the fixing member 67 with respect to the rotation shaft 61 is defined with the contact surface 67*h* coming into contact with the first linear portion 61*b* of the rotation shaft 61. Thus, phase shift of the conveying force applying member 65 with respect to the rotation shaft 61 can be more reliably suppressed with a simple structure.

In the fixing member 67 according to the present embodiment, regulating portions 67*e* and 67*f* are formed on both sides of the restraining portion 67*c* in the rotation direction. Accordingly, the conveying force applying member 65 is held in the rotation direction, whereby the phase shift of the conveying force applying member 65 with respect to the rotation shaft 61 is suppressed.

As illustrated in FIG. 3, FIG. 4, and FIG. 8, the second pullback unit 60 includes a pressing portion 72 that presses the medium from above at a position different in phase from the contact part 65*b* in the rotation direction. As illustrated in FIG. 8, the pressing portion 72 is formed with an amount of protrusion in the radial direction being smaller than that of the contact part 65*b*. The pressing portion 72 provides a function of pressing a bulge generated in the media P from above, and suppresses floating of the medium P from the processing tray 42. Thus, the media P can be appropriately aligned.

The pressing portion 72 can be formed of a sheet material having elasticity, and is formed of a polyethylene terephthalate (PET) sheet in the present embodiment.

The two pressing portions 72 are integrally formed using a coupling portion 72*a*, and are fixed to the rotation shaft 61, together with the fixed portion 67*a* of the fixing member 67, using the screw 68. Thus, no dedicated means for fixing the pressing portion 72 is required, whereby the number of components and cost can be reduced.

As described above, in the second pullback unit 60 according to the present embodiment, since the holding member 63 includes the shaft hole 63*d* through which the rotation shaft 61 passes and is configured to be fixed to the rotation shaft 61 in a state of sliding in the axis direction, the holding member 63 can be attached to the rotation shaft 61 even when the holding member 63 is formed of a material having high hardness, and thus phase shift of the holding member 63 with respect to the rotation shaft 61 can be suppressed.

The number, thicknesses, positions, and the like of the contact parts 65*b* formed in the conveying force applying member 65 may be changed in accordance with the specifications of the attachment target device. Thus, if the conveying force applying member 65 and the holding member 63 correspond to each other on a one-to-one basis, the design of the holding member 63 needs to be changed and the holding member 63 needs to be replaced, resulting in a compromised versatility.

However, since the conveying force applying member 65 held by the holding member 63 is configured to be attached to and detached from the holding member 63 via the opening portion 65*d* in the direction crossing the axis direction of the rotation shaft 61, the conveying force applying member 65 can be easily replaced from the holding member 63. Thus, the holding member 63 can be used in common among apparatuses having different specifications, and versatility can be enhanced.

Since the plurality of rotation bodies 62, each being a set of the conveying force applying member 65, the holding member 63, and the fixing member 67, are provided along the axis direction of the rotation shaft 61, the medium P can be conveyed more reliably than with a configuration including one rotation body 62 in the axis direction.

When the plurality of rotation bodies 62 are provided in the axis direction, in a configuration in which the conveying force applying member 65 is configured to be attached and detached in the axis direction, another rotation body 62 becomes an obstacle. However, since the conveying force applying member 65 is configured to be attached and detached in a direction crossing the axis direction, another rotation body 62 does not become an obstacle, and the conveying force applying member 65 can be easily attached and detached.

As illustrated in FIG. 3, the first guide 55 and the second guide 56 provided in the upper portion of the processing tray 42 are located at positions shifted from the conveying force applying member 65 in the axis direction of the rotation shaft 61. Accordingly, the first guide 55 and the second guide 56 are less likely to be an obstacle when the conveying force applying member 65 is attached and detached.

Figure 9:
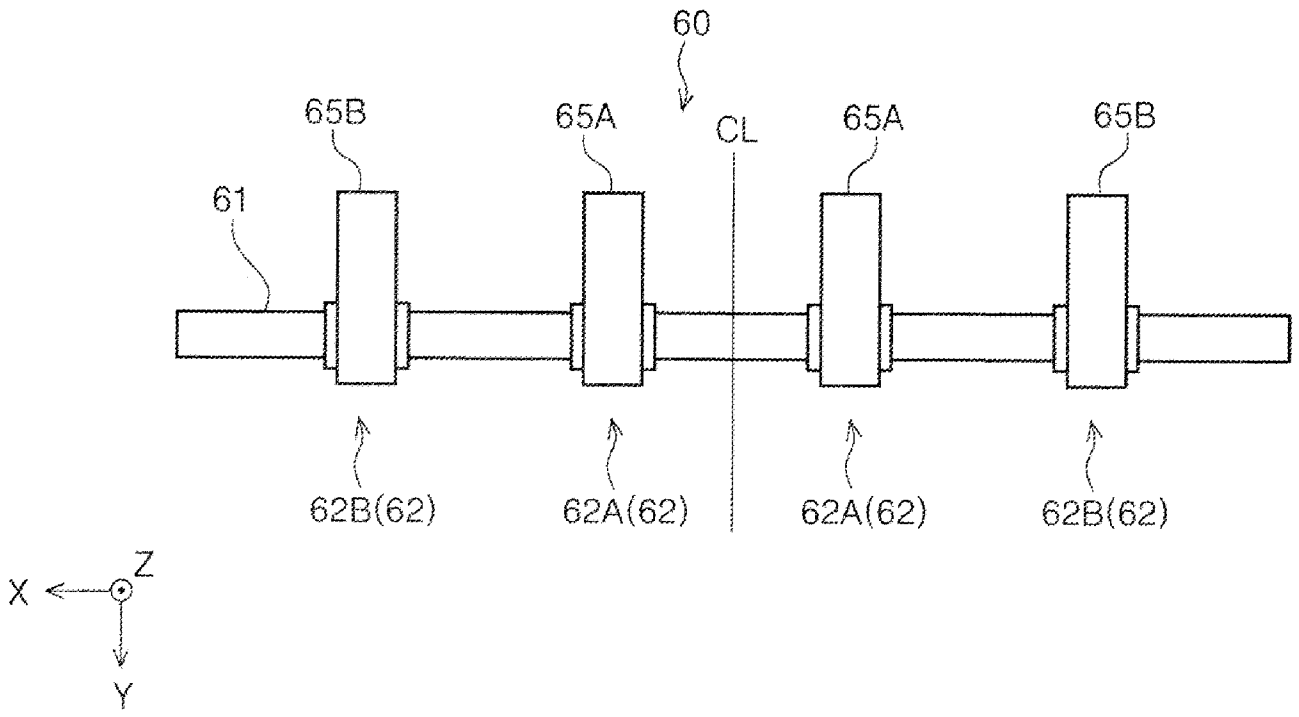
FIG. 9 is a plan view of a rotation unit according to another embodiment.

While two rotation bodies 62 are provided in the axis direction in the present embodiment, the present disclosure is not limited thereto. When the plurality of rotation bodies 62 are provided in the width direction, a configuration as illustrated in FIG. 9 can be adopted as an example. In FIG. 9, the rotation bodies 62 include two first rotation bodies 62A that are provided to sandwich a center position CL in the width direction, while being equidistant from the center position CL, and two second rotation bodies 62B that are located closer to an edge of the medium P in the width direction than the first rotation bodies 62A are, and are provided to sandwich the center position CL, while being equidistant from the center position CL. The second rotation bodies 62B are configured to apply larger conveying force to the medium P than the first rotation bodies 62A.

Specifically, for example, a conveying force applying member 65B in the second rotation bodies 62B may be formed of a material having higher hardness than a conveying force applying member 65A in the first rotation bodies 62A. Alternatively, the width of the conveying force applying member 65B in the axis direction may be larger than the width of the conveying force applying member 65A in the axis direction. Alternatively, the length of the conveying force applying member 65B in the protruding direction may be longer than the length of the conveying force applying member 65A in the protruding direction. Alternatively, the above conditions may be combined. As a result, the second rotation bodies 62B can apply larger conveying force to the medium P than the first rotation bodies 62A.

With such a configuration, the following operational effects are obtained. The plurality of rotation bodies 62 provided in the width direction designed to apply the same conveying force to the medium P, may lead to variation in conveying force among the plurality of rotation bodies 62 due to an assembly error, aging, or the like, which may result in skew of the medium P. As described above, by making the conveying force applied to the media P by the second rotation body 62B larger than the conveying force applied to the media P by the first rotation body 62A, it is possible to suppress the occurrence of the variation in the conveying force in the width direction as described above and to suppress the occurrence of the skew described above.

The present disclosure is not intended to be limited to the aforementioned exemplary embodiment, and many variations are possible within the scope of the present disclosure as described in the appended claims. It goes without saying that such variations also fall within the scope of the present disclosure.

For example, in the present embodiment, the rotation unit according to the present disclosure is applied to the second pullback unit 60, but may be applied to the first pullback unit 48.

What is claimed is:

1. A rotation unit configured to rotate to apply conveying force to a medium, the rotation unit comprising:

a conveying force applying unit including at least one contact part that is arranged in a rotation direction and comes into contact with the medium, and configured to apply the conveying force to the medium using the contact part;

a rotation shaft to which the conveying force applying unit is attached;

a holding unit provided between the rotation shaft and the conveying force applying unit, and configured to hold the conveying force applying unit; and a fixing unit configured to fix the conveying force applying unit to the rotation shaft, wherein the holding unit includes a shaft hole through which the rotation shaft passes, and is fixed in a state of being attached to the rotation shaft by sliding in an axis direction of the rotation shaft, the conveying force applying unit includes:

a base portion provided with a fitting hole that fits an outer circumference of the holding unit and an opening portion in communication with the fitting hole; and the contact part that is provided on and protrudes from the base portion, the base portion is configured to deform, and the conveying force applying unit is configured to be attached to and detached from the holding unit via the opening portion in a direction crossing the axis direction of the rotation shaft.

2. The rotation unit according to claim 1, wherein the rotation shaft has, on an outer circumference, a first arc portion and a first linear portion along a circumference direction, and the shaft hole of the holding unit is shaped to fit the outer circumference of the rotation shaft.

3. The rotation unit according to claim 2, wherein the holding unit has, on the outer circumference, a second arc portion and a second linear portion along a circumference direction, and the fitting hole of the base portion is shaped to fit the outer circumference of the holding unit.

4. The rotation unit according to claim 3, wherein the holding unit has, on the second linear portion, a protruding portion protruding in a radial direction, and the base portion of the conveying force applying unit includes a portion that comes into contact with the protruding portion in the rotation direction.

5. The rotation unit according to claim 4, wherein the base portion of the conveying force applying unit is shaped to sandwich the protruding portion with a first portion and a second portion in the rotation direction.

6. The rotation unit according to claim 5, wherein the protruding portion is provided at a position shifted from a center position of the second linear portion as viewed in the axis direction of the rotation shaft.

7. The rotation unit according to claim 6, wherein the fixing unit includes a fixing member fixed to the rotation shaft, and the fixing member includes:

a fixed portion that is a portion fixed to the rotation shaft; and a restraining portion configured to restrain the protruding portion, the first portion, and the second portion.

8. The rotation unit according to claim 7, wherein the fixed portion and the restraining portion are located at positions shifted from each other in the axis direction of the rotation shaft, and the fixing member includes a phase defining portion that is configured to define a phase of the fixing member with respect to the rotation shaft, and is a portion to be in contact with the first linear portion of the rotation shaft, the phase defining portion being located on a side opposite to the fixed portion in the axis direction with the restraining portion provided therebetween.

9. The rotation unit according to claim 7, further comprising a pressing portion configured to press the medium from above at a position different in phase from the contact part in the rotation direction, wherein the pressing portion is fixed to the rotation shaft together with the fixed portion of the fixing member.

10. The rotation unit according to claim 1, wherein the conveying force applying unit includes a plurality of the contact parts arranged in the rotation direction.

11. The rotation unit according to claim 1, wherein a plurality of rotation bodies are provided along the axis direction of the rotation shaft, the rotation bodies each being a set of the conveying force applying unit, the holding unit, and the fixing unit.

12. The rotation unit according to claim 11, wherein the axis direction of the rotation shaft is a width direction of the medium, the plurality of rotation bodies provided along the width direction include:

two first rotation bodies that are provided to sandwich a center position in the width direction, while being equidistant from the center position, and two second rotation bodies that are located closer to an edge of the medium in the width direction than the first rotation bodies are, and are provided to sandwich the center position, while being equidistant from the center position, and conveying force applied to the medium from the second rotation bodies is larger than conveying force applied to the medium from the first rotation bodies.

13. A post-processing device configured to execute post-processing on a medium on which recording is performed by a recording device, the post-processing device comprising:

a processing tray on which the medium to be subjected to the post-processing is loaded;

an alignment unit configured to align an edge of the medium loaded on the processing tray;

the rotation unit described in claim 1 configured to apply conveying force toward the alignment unit, to the medium; and a post-processing unit configured to execute the post-processing on the medium loaded on the processing tray.

14. The post-processing device according to claim 13, further comprising a guide positioned above the processing tray and configured to guide, toward the alignment unit, the medium sent toward the alignment unit by the rotation unit, wherein the guide is located at a position shifted from the conveying force applying unit in the axis direction of the rotation shaft.

15. A conveying force applying member in a rotation unit including the conveying force applying member configured to apply conveying force to a medium, a rotation shaft to which the conveying force applying member is attached, a holding unit provided between the rotation shaft and the conveying force applying member, configured to hold the conveying force applying member, including a shaft hole through which the rotation shaft passes, and is fixed in a state of being attached to the rotation shaft by sliding in an axis direction of the rotation shaft, and a fixing unit configured to fix the conveying force applying member to the rotation shaft, the conveying force applying member comprising:

a base portion provided with a fitting hole that fits an outer circumference of the holding unit and an opening portion in communication with the fitting hole; and a contact part that is provided on and protrudes from the base portion, and configured to come into contact with the medium to apply the conveying force to the medium, wherein the base portion is configured to deform, and the conveying force applying member is configured to be attached to and detached from the holding unit via the opening portion in a direction crossing the axis direction of the rotation shaft.

* * * * *